US012330080B2

(12) United States Patent
Xie

(10) Patent No.: US 12,330,080 B2
(45) Date of Patent: Jun. 17, 2025

(54) FINGER GYRO SPHERICAL AIRCRAFT

(71) Applicant: Shenzhen Junao trading Co., LTD, Shenzhen (CN)

(72) Inventor: Guanglong Xie, Beiliu (CN)

(73) Assignee: Shenzhen Junao trading Co., LTD, Shenzhen (CN)

( * ) Notice: Subject to any disclaimer, the term of this patent is extended or adjusted under 35 U.S.C. 154(b) by 212 days.

(21) Appl. No.: 18/449,048

(22) Filed: Aug. 14, 2023

(65) Prior Publication Data

US 2025/0058240 A1 Feb. 20, 2025

(51) Int. Cl.
*A63H 27/00* (2006.01)
*A63H 29/22* (2006.01)

(52) U.S. Cl.
CPC ..... *A63H 27/00* (2013.01); *A63H 29/22* (2013.01)

(58) Field of Classification Search
CPC ..... A63H 27/00; A63H 27/12; A63H 27/14; A63H 29/22; B64C 39/024; B64C 39/028; B64C 39/029
See application file for complete search history.

(56) References Cited

U.S. PATENT DOCUMENTS

2021/0114730 A1* 4/2021 Macdonald ..... F16C 19/10
2022/0314137 A1* 10/2022 Liao ..... A63B 65/00
2024/0359112 A1* 10/2024 Liao ..... A63H 27/00

FOREIGN PATENT DOCUMENTS

CN 202666400 U 1/2013
CN 104724286 A 6/2015
CN 206327570 U 7/2017

* cited by examiner

*Primary Examiner* — Thomas M Sember
(74) *Attorney, Agent, or Firm* — Nitin Kaushik

(57) ABSTRACT

A finger gyro spherical aircraft is disclosed according to the present application, including a protective net and a flying body mounted in the protective net, the flying body is provided with an upper shell and a lower shell, the upper shell and the lower shell are assembled to form a mounting cavity, a PCB board, a battery and a motor are mounted in the mounting cavity, the motor has a driving shaft, which extends to an outer end of the upper shell and is connected to a fan blade; the protective net is spherical with a hollow air inlet hole, a top end of the protective net is rotatably provided with a first finger pressing member, a second finger pressing member is rotatably arranged at a bottom end of the protective net.

9 Claims, 8 Drawing Sheets

FINGER GYRO SPHERICAL AIRCRAFT

TECHNICAL FIELD

The present application relates to the field of toys, and in particular to a finger gyro spherical aircraft.

BACKGROUND

Toy aircraft is a kind of toy loved by model airplane enthusiasts and teenagers. For example, CN202666400U and CN206327570U disclose two common types of aircraft toys on the market. However, there are still some shortcomings in the existing aircraft toys. Specifically, the existing aircraft toys are complex in structure and large in size, which is inconvenient for players to grasp when flying: at the same time, it also has the problem of high assembly costs and relatively single gameplay.

Therefore, there is a need of developing a novel technical solution to solve the aforementioned problems.

SUMMARY

In order to solve the defects and deficiencies of the conventional technology, a finger gyro spherical aircraft is provided according to the present application, and compared to some existing spherical aircraft, it has a simpler structure and reduces the overall weight of the aircraft by directly connecting the wind blades with the driving shaft of the motor, the overall volume of the aircraft is also reduced, which is more conducive to the flight of the aircraft; finger pressing members are arranged at both ends of a protective net, which increases the playing style of spherical aircraft and improves the interest and market competitiveness of products.

For the above-mentioned purpose, the present invention provides a technical solution as follows:

A finger gyro spherical aircraft, including a protective net and a flying body mounted in the protective net, the flying body is provided with an upper shell and a lower shell, the upper shell and the lower shell are assembled to form a mounting cavity, a PCB board, a battery and a motor are mounted in the mounting cavity, and the PCB board is electrically connected with the battery and the motor; the motor has a driving shaft, which extends to an outer end of the upper shell and is connected to a fan blade;

the protective net is spherical with a hollow air inlet hole, a top end of the protective net is rotatably provided with a first finger pressing member, a second finger pressing member is rotatably arranged at a bottom end of the protective net.

As a preferred solution, the PCB board is horizontally arranged in the mounting cavity, and two ends of the PCB board extend out of the mounting cavity.

As a preferred solution, the PCB board is arranged above the battery, the motor is vertically arranged in the mounting cavity, an avoidance hole is defined on the PCB board, and a lower end of the motor passes through the avoidance hole to contact with an upper side of the battery.

As a preferred solution, the battery is arranged right below the motor.

As a preferred solution, a motor cap is provided at an upper part of the upper shell corresponding to the motor.

As a preferred solution, a connecting ring extends outward from the upper shell or the lower shell.

As a preferred solution, a heat dissipation hole is defined on the lower shell.

As a preferred solution, a first T-shaped groove is defined at the top end of the protective net, and the first finger pressing member is provided with a first connecting column adapted to the first T-shaped groove, and a first bearing is arranged between the first connecting column and the first T-shaped groove;

a second T-shaped groove is defined at the bottom end of the protective net, and the second finger pressing member is provided with a second connecting column adapted to the second T-shaped groove, and a second bearing is arranged between the second connecting column and the second T-shaped groove.

As a preferred solution, the PCB board is provided with a main control chip, and the main control chip is electrically connected with a sensor.

Compared with the conventional technology, the present application has obvious advantages and beneficial effects, specifically, from the above technical solution, it can be seen that the driving shaft of the motor is directly connected with the blades, so that compared with some existing spherical aircraft, the structure is simpler, the overall weight can be reduced, and the overall volume of the aircraft is also reduced, thus being more conducive to the flight of the aircraft; finger pressing members are arranged at both ends of the protective net, which increases the gameplay of spherical aircraft and improves the interest and market competitiveness of products.

In order to illustrate the structural features and effects of the present invention more clearly, the present invention will be described in detail below in combination with the accompanying drawings and specific embodiments.

DESCRIPTION OF REFERENCE SIGNS IN DRAWINGS

10, protective net; 101, upper net cover; 102, lower net cover; 11, first finger pressing member; 12, second finger pressing member; 13, first bearing; 14, second bearing; 20, flying body; 21, upper shell; 211, motor cap; 212, connecting ring; 22, lower shell; 221, heat dissipation hole; 23, PCB board; 231, avoidance hole; 24, battery; 25, motor; 26 fan blade.

DETAILED DESCRIPTION OF THE EMBODIMENTS

The technical solutions in the embodiments of the present invention are clearly and completely described below with reference to the accompanying drawings. Apparently, the described embodiments are merely preferred embodiments of the present invention.

It should be noted that when an element is referred to as being "immobilized" to another element, it may be immobilized to another element, directly or via an intermediate element(s). When an element is referred to as being "connected" to another element, it may be connected to another element, directly or via an intermediate element(s). The terms "vertical," "horizontal," "left," "right," and the like used herein are for the purpose of illustration only and do not indicate these embodiments exclusively.

Unless otherwise defined, all technical and scientific terms used herein have the same meaning as commonly understood by persons of ordinary skill in the technical field of the present invention. The terms used herein are only for the purpose of describing specific embodiments, rather than intended to limit the present invention. The term "and/or" as used herein includes any and all combinations of one or more of the related items as listed.

Figure 1:
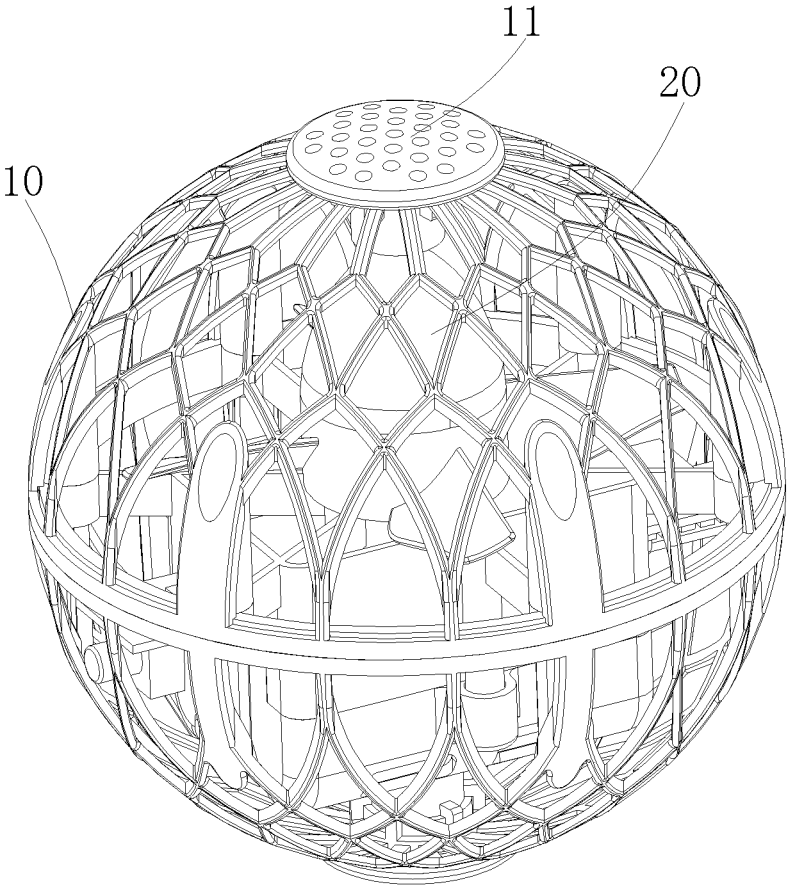
FIG. 1 is a schematic perspective view of an embodiment of the present application.
Figure 2:
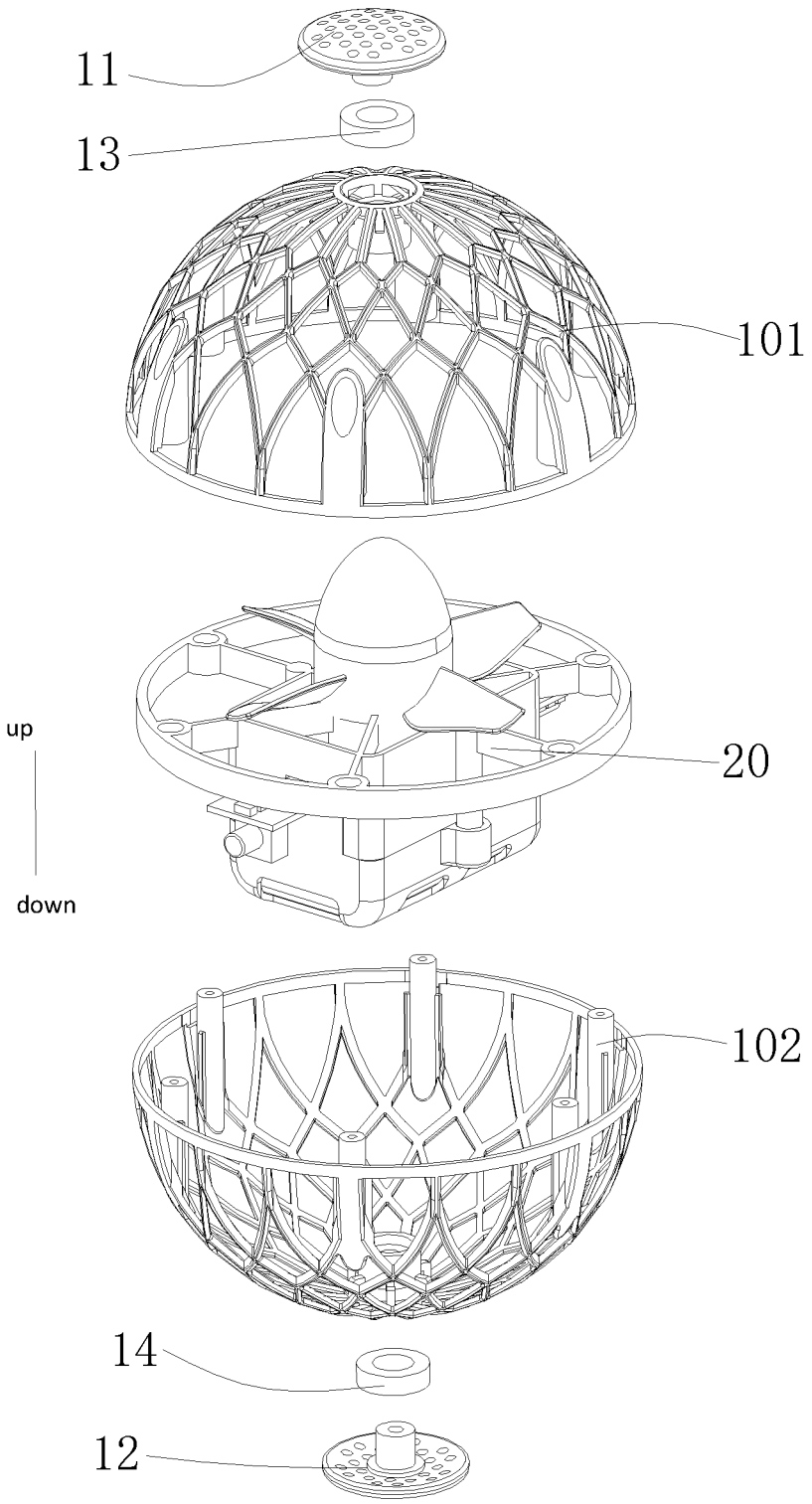
FIG. 2 is a first exploded view of the embodiment of the present application.
Figure 3:
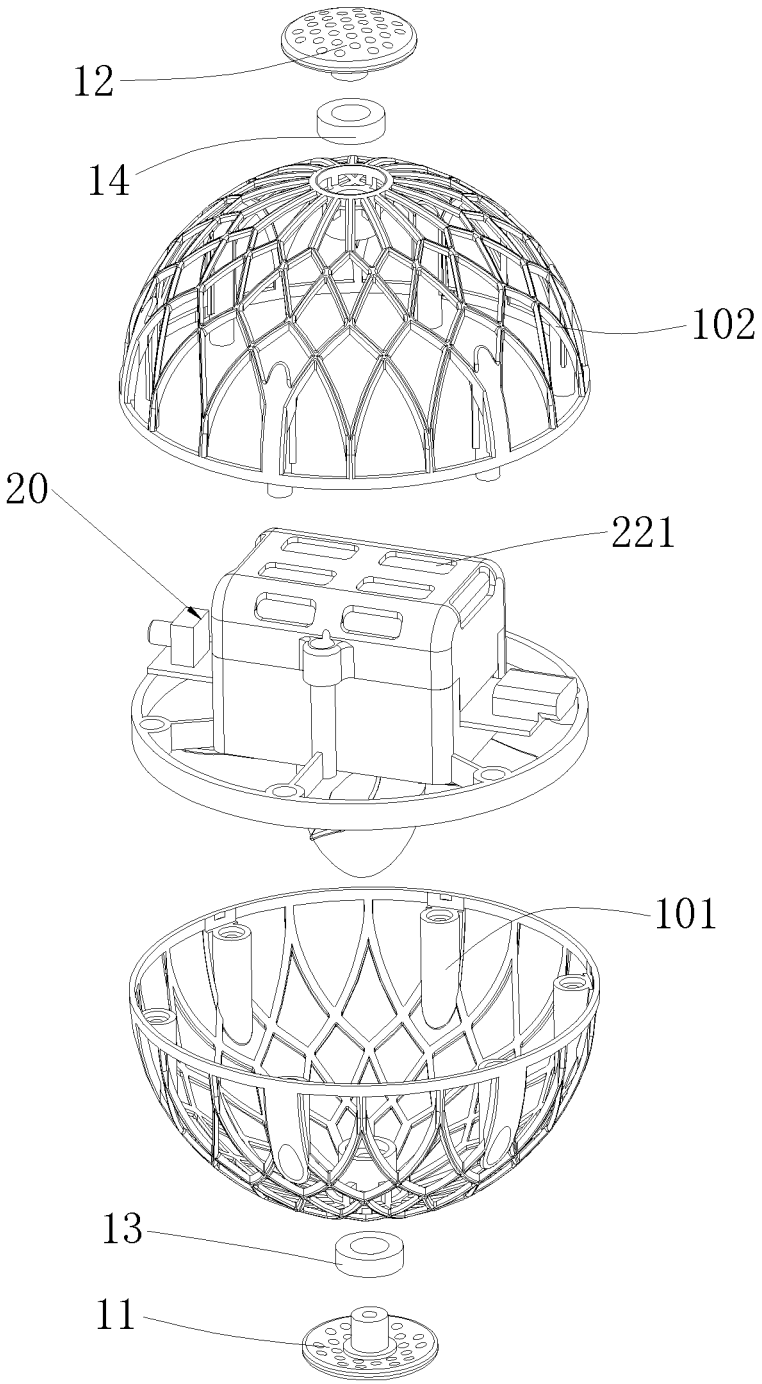
FIG. 3 is a second exploded view of the embodiment of the present application.
Figure 4:
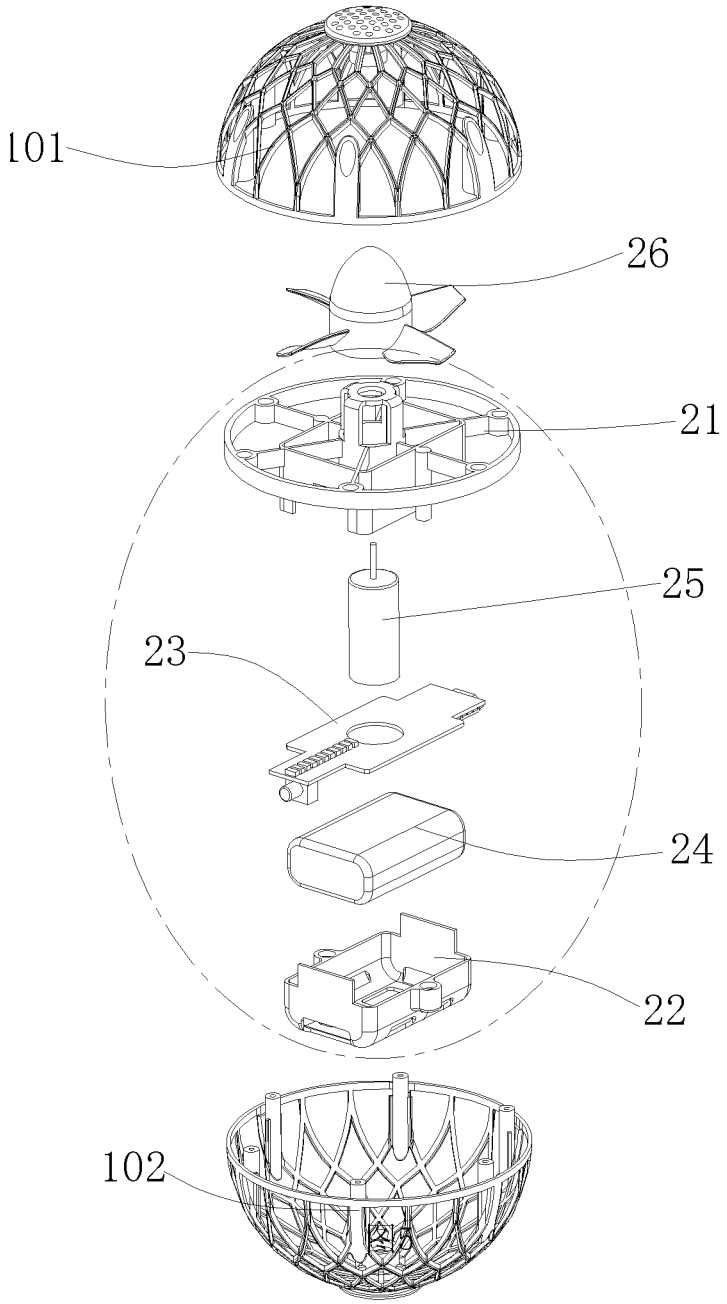
FIG. 4 is a third exploded view of the embodiment of the present application.
Figure 5:
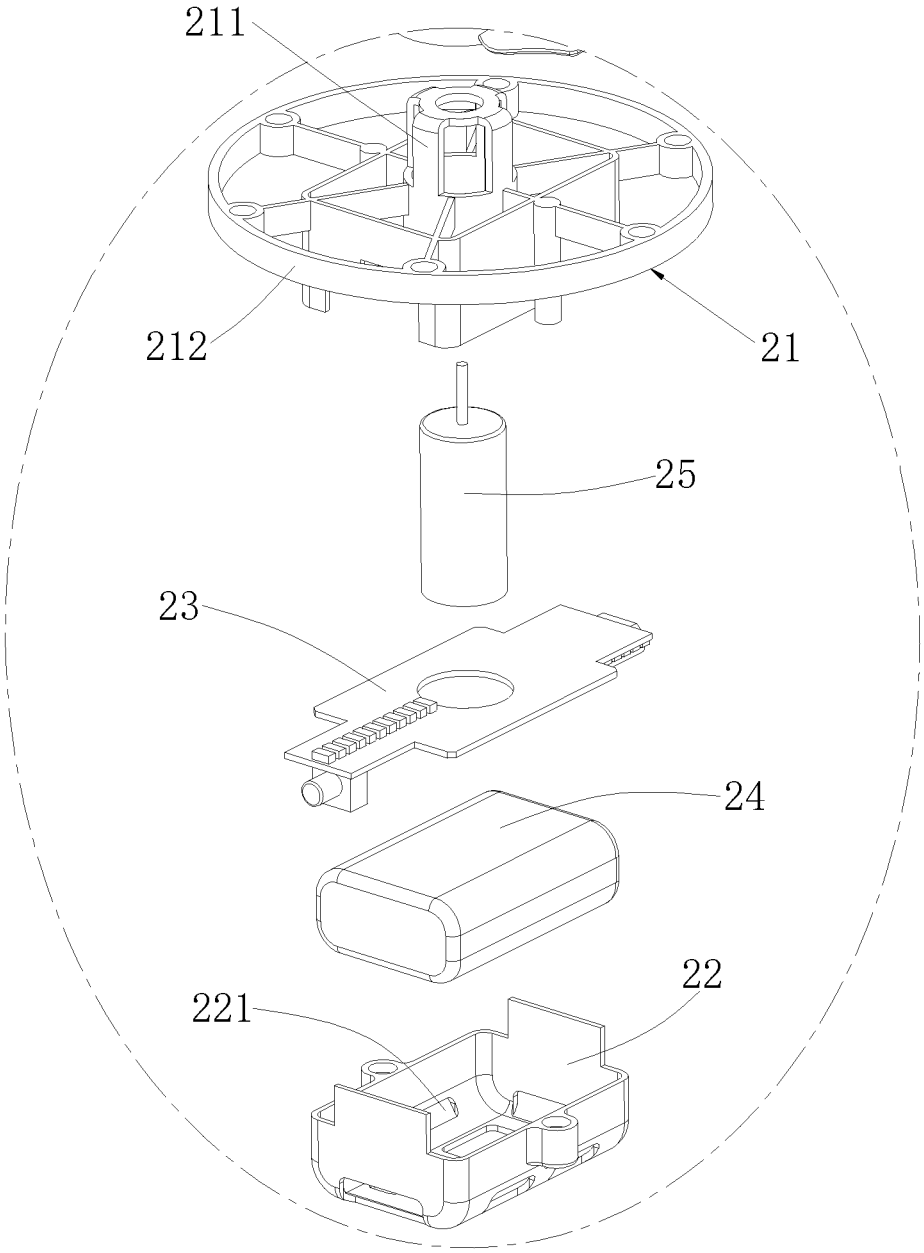
FIG. 5 is an enlarged view of a part of FIG. 4.
Figure 6:
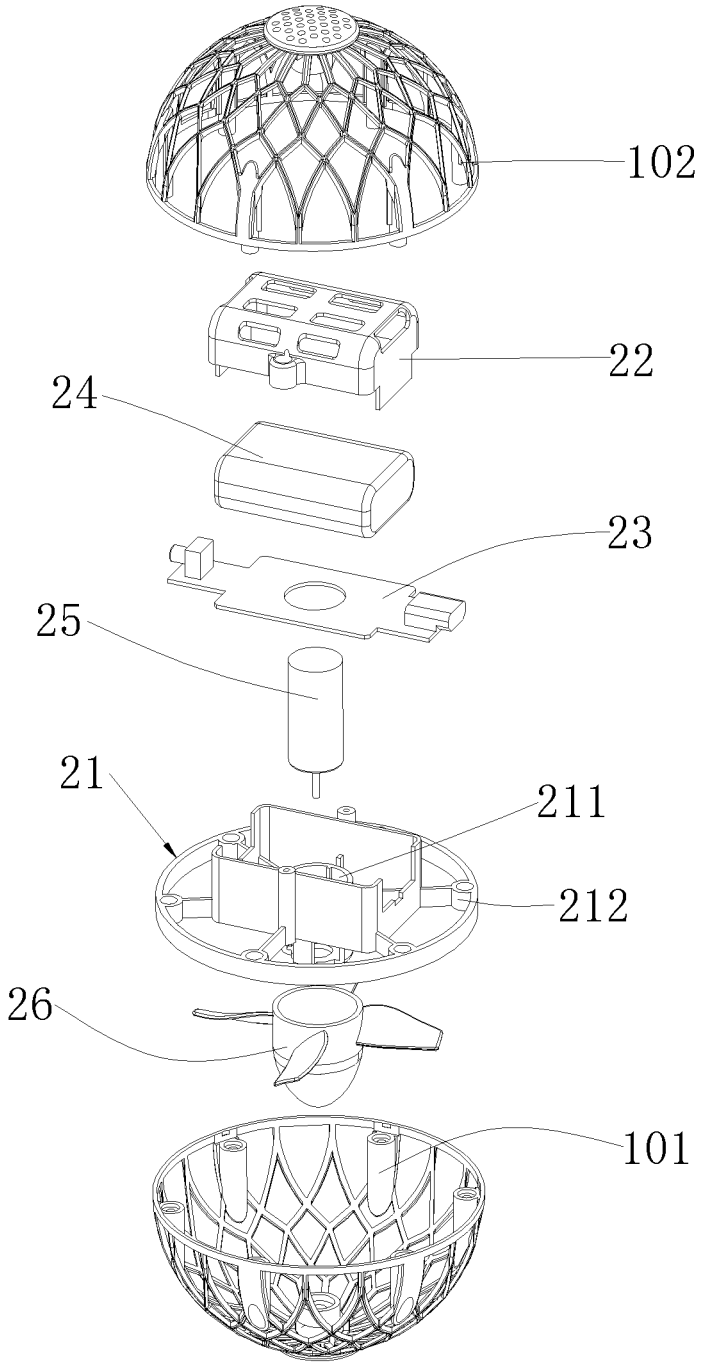
FIG. 6 is a fourth exploded view of the embodiment of the present application.
Figure 7:
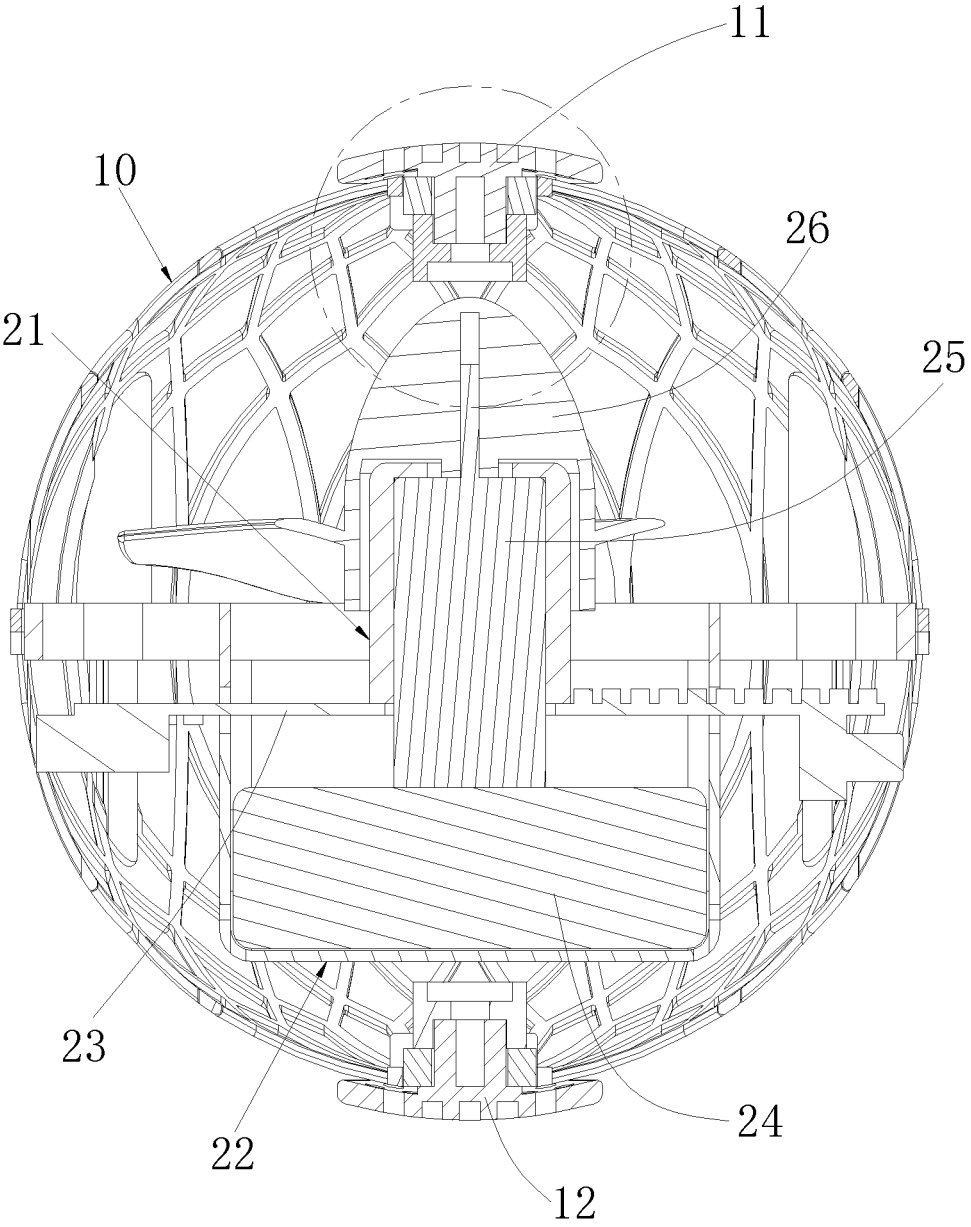
FIG. 7 is a cross-sectional schematic diagram of an embodiment of the present application.
Figure 8:
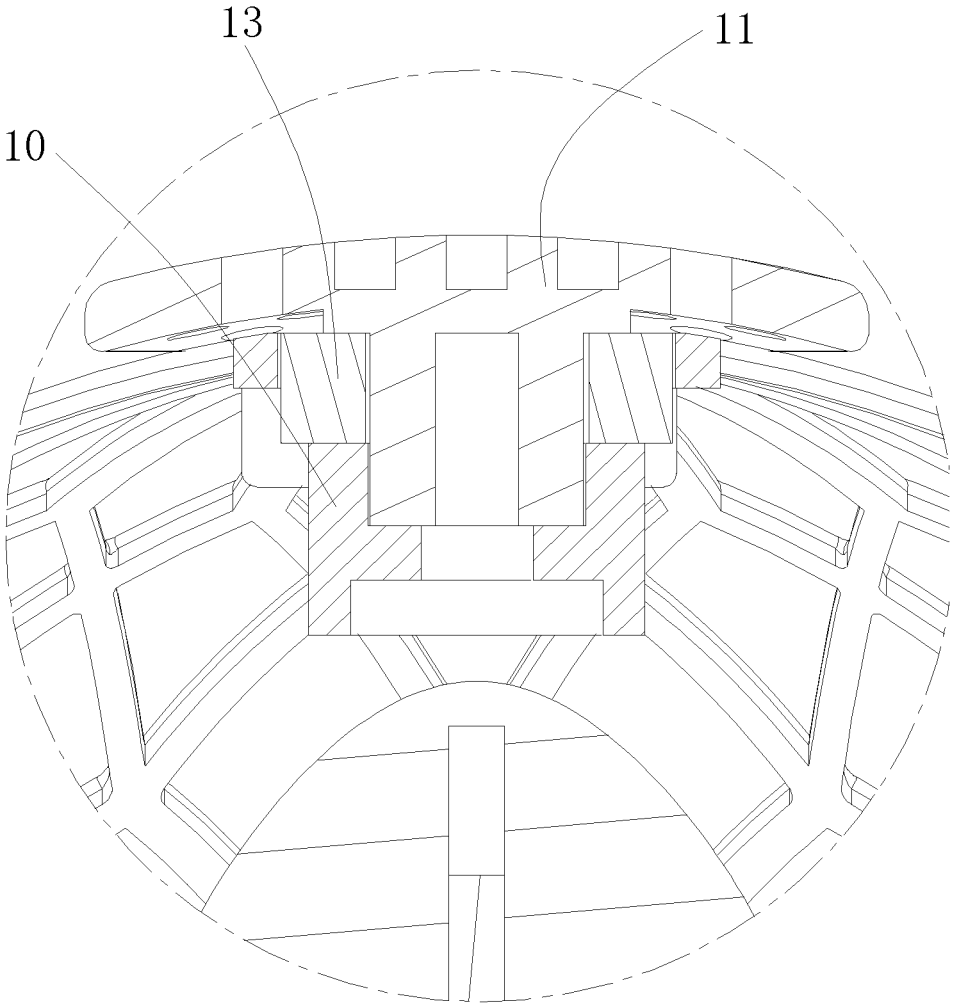
FIG. 8 is an enlarged view of a part of FIG. 7.

Referring to FIG. 1 to FIG. 8, a finger gyro spherical aircraft is provided in an embodiment of the present application, including a protective net 10 and a flying body 20 mounted in the protective net 10, the flying body 20 is provided with an upper shell 21 and a lower shell 22, the upper shell and the lower shell are assembled to form a mounting cavity, a PCB board 23, a battery 24 and a motor 25 are mounted in the mounting cavity, and the PCB board 23 is electrically connected with the battery 24 and the motor 25; the motor 25 has a driving shaft, which extends to an outer end of the upper shell 21 and is connected to a fan blade 26;

the protective net 10 is spherical with hollow holes, a first finger pressing member 11 is rotatably connected to a top end of the protective net 10, and a second finger pressing member 12 is rotatbly connected to a bottom end of the protective net 10.

The driving shaft of the motor 25 is directly connected to the fan blades 26, compared with some existing spherical aircraft, the structure is simpler, and the overall weight of the aircraft can be reduced, thus being more conducive to the flight of the aircraft and effectively reducing the overall volume of the aircraft; finger pressing members are arranged at both ends of the protective net 10, so that a user may measure two fingers with one hand to hold against the two finger pressing members, and rotate the protective net 10 with the other hand, thus realizing another game of spherical aircraft, improving the interest of products and improving the market competitiveness of products.

Specifically, the PCB board 23 is horizontally arranged in the mounting cavity, and two ends of the PCB board extend out of the mounting cavity. The PCB board 23 is provided with a control switch and a charging port, and the control switch and the charging port are arranged at a part of the PCB board 23 extending out of the mounting cavity, moreover, the PCB board 23 extends horizontally out of the mounting cavity, which may also improve a balance force of the aircraft during flight (play the role of a horizontal support frame) and improve the flight stability; further, the PCB board 23 is arranged above the battery 24, and the motor 25 is vertically arranged in the mounting cavity. An avoidance hole 231 is defined on the PCB board 23, and the lower end of the motor 25 passes through the avoidance hole 231 to contact the upper side of the battery 24. In this way, through the specific design of each component in the mounting cavity, it is not only reasonable, but also further reduces the size of the product; at the same time, the avoidance hole 231 is defined on the PCB board 23, which also has the function of limiting the motor 25 and improving the assembly stability; preferably, the battery 24 is arranged directly below the motor 25 (i.e. in the middle position); of course, it is also possible to arrange two batteries 24 in columns on one side of the motor, with the symmetrical centers of the two batteries falling directly below the motor 25, thus maintaining good balance.

Preferably, a heat dissipation hole 221 is defined on the lower shell 22.

In order to improve the mounting stability of the motor 25, a motor cap 211 is arranged on the upper part of the upper shell 21 corresponding to the motor 25. Generally, the upper shell 21 or the lower shell 22 extends outward with a connecting ring 212, and the flying body 20 is connected to the protective net 10 through the connecting ring 212.

The protective net 10 consists of an upper net cover 101 and a lower net cover 102; further: a first T-shaped groove is defined at the top end of the protective net 10, and the first finger pressing member 11 is provided with a first connecting column adapted to the first T-shaped groove, and a first bearing 13 is arranged between the first connecting column and the first T-shaped groove;

a second T-shaped groove is defined at the bottom end of the protective net 10, and the second finger pressing member 12 is provided with a second connecting column adapted to the second T-shaped groove, and a second bearing 14 is arranged between the second connecting column and the second T-shaped groove. In this way, the smoothness of the product during rotation is further improved by arranging bearings at the finger pressing member.

Preferably, the PCB board is provided with a main control chip, and the main control chip is electrically connected with a sensor. The sensor may be an acceleration sensor. In case that the aircraft is caught by human hands or collides during flight, the sensor sends relevant signals to the main control chip, which controls the motor 25 to stop working: of course, the sensor may also be an infrared sensor used for monitoring obstacles (obstacle avoidance).

It should be noted that the up and down directions (and left and right directions) defined in this embodiment are only for the convenience of description. When the aircraft of this application is actually flying, the up and down directions of the aircraft are opposite to the up and down directions defined in this specification.

The design emphasis of the present application lies in that, the driving shaft of the motor is directly connected with the blades, so that compared with some existing spherical aircraft, the structure is simpler, the overall weight can be reduced, and the overall volume of the aircraft is also reduced, thus being more conducive to the flight of the aircraft; finger pressing members are arranged at both ends of the protective net, which increases the gameplay of spherical aircraft and improves the interest and market competitiveness of products.

The above descriptions are merely preferred embodiments of the present invention, and shall not be construed as limitation to the technical scope of the present invention. Hence, any minor amendments, equivalent variations or modifications made to these embodiments according to the technical substance of the present invention shall still fall within the scope of technical solutions of the present invention.

What is claimed is:

1. A finger gyro spherical aircraft, comprising a protective net and a flying body mounted in the protective net, wherein the flying body is provided with an upper shell and a lower shell, the upper shell and the lower shell are assembled to form a mounting cavity, a PCB board, a battery and a motor are mounted in the mounting cavity, and the PCB board is electrically connected with the battery and the motor; wherein the motor has a driving shaft, which extends to an outer end of the upper shell and is connected to a fan blade;

the protective net is spherical with a hollow air inlet hole, a top end of the protective net is rotatably provided with a first finger pressing member, a second finger pressing member is rotatably arranged at a bottom end of the protective net.

2. The finger gyro spherical aircraft according to claim 1, wherein the PCB board is horizontally arranged in the mounting cavity, and two ends of the PCB board extend out of the mounting cavity.

3. The finger gyro spherical aircraft according to claim 2, wherein the PCB board is arranged above the battery, the motor is vertically arranged in the mounting cavity, an avoidance hole is defined on the PCB board, and a lower end of the motor passes through the avoidance hole to contact with an upper side of the battery.

4. The finger gyro spherical aircraft according to claim 3, wherein the battery is arranged right below the motor.

5. The finger gyro spherical aircraft according to claim 3, wherein a motor cap is provided at an upper part of the upper shell corresponding to the motor.

6. The finger gyro spherical aircraft according to claim 2, wherein a connecting ring extends outward from the upper shell or the lower shell.

7. The finger gyro spherical aircraft according to claim 6, wherein a heat dissipation hole is defined on the lower shell.

8. The finger gyro spherical aircraft according to claim 1, wherein a first T-shaped groove is defined at the top end of the protective net, and the first finger pressing member is provided with a first connecting column adapted to the first T-shaped groove, and a first bearing is arranged between the first connecting column and the first T-shaped groove;

a second T-shaped groove is defined at the bottom end of the protective net, and the second finger pressing member is provided with a second connecting column adapted to the second T-shaped groove, and a second bearing is arranged between the second connecting column and the second T-shaped groove.

9. The finger gyro spherical aircraft according to claim 1, wherein the PCB board is provided with a main control chip, and the main control chip is electrically connected with a sensor.

* * * * *